US009527219B2

(12) United States Patent
Iwasaki et al.

(10) Patent No.: US 9,527,219 B2
(45) Date of Patent: Dec. 27, 2016

(54) ELECTRIC SHAVER

(75) Inventors: Jyuzaemon Iwasaki, Shiga-ken (JP); Makoto Fukutani, Shiga-ken (JP); Hiroaki Shimizu, Shiga-ken (JP); Toshio Ikuta, Shiga-ken (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 514 days.

(21) Appl. No.: 13/392,708

(22) PCT Filed: Sep. 21, 2010

(86) PCT No.: PCT/JP2010/066332
§ 371 (c)(1),
(2), (4) Date: Feb. 27, 2012

(87) PCT Pub. No.: WO2011/037110
PCT Pub. Date: Mar. 31, 2011

(65) Prior Publication Data

US 2012/0151773 A1 Jun. 21, 2012

(30) Foreign Application Priority Data

Sep. 25, 2009 (JP) ..... 2009-220456

(51) Int. Cl.
*B26B 19/04* (2006.01)
*B26B 19/28* (2006.01)

(52) U.S. Cl.
CPC ..... *B26B 19/048* (2013.01); *B26B 19/282* (2013.01)

(58) Field of Classification Search
CPC ..... B26B 19/00; B26B 19/02; B26B 19/04; B26B 19/046; B26B 19/048; B26B 19/12; B26B 19/28; B26B 19/282; B26B 19/284; B26B 19/38; B26B 19/3853; B26B 21/52; B26B 21/521; B26B 21/526; H02K 33/00; H02K 33/12; H02K 33/14; H02K 33/18
(Continued)

(56) References Cited

U.S. PATENT DOCUMENTS 3,756,105 A * 9/1973 Balamuth ..... B26B 19/00 30/45
3,898,732 A * 8/1975 Krainer ..... 30/43.92
(Continued)

FOREIGN PATENT DOCUMENTS

DE 10242094 A1 4/2004
DE 10 2005044176 A1 3/2007
(Continued)

OTHER PUBLICATIONS

International Preliminary Report on Patentability and Written Opinion of the International Searching Authority for International Application No. PCT/JP2010/066332 dated Apr. 11, 2012.
(Continued)

*Primary Examiner* — Jason Daniel Prone
(74) *Attorney, Agent, or Firm* — Wolf, Greenfield & Sacks, P.C.

(57) ABSTRACT

A height dimension D1 of a head section 4 is smaller than a front-back dimension D2 of the head section 4. The head section 4 has therein a linear actuator 12 as a drive source. Inner blades 13 are coupled to a drive coupling section protruding form an actuator main section. A height dimension of the actuator main section is smaller than a front-back dimension of the actuator main section.

1 Claim, 4 Drawing Sheets

(58) Field of Classification Search
USPC ..... 30/42, 43.7–43.92, 44–46; 310/15, 17, 310/20, 28
See application file for complete search history.

(56) References Cited

U.S. PATENT DOCUMENTS

| | | | | |
|---|---|---|---|---|
| 3,906,263 | A * | 9/1975 | Chen et al. | 30/43.92 |
| 3,962,783 | A * | 6/1976 | Rentema | B26B 19/102 30/43.92 |
| 4,240,200 | A * | 12/1980 | Bukoschek | B26B 19/282 30/43.92 |
| 5,921,134 | A * | 7/1999 | Shiba et al. | 30/43.92 |
| 6,559,563 | B1 * | 5/2003 | Shimizu et al. | 30/43.92 |
| 6,933,630 | B2 * | 8/2005 | Kraus et al. | 30/43.7 |
| 6,991,217 | B2 * | 1/2006 | Shimizu et al. | 30/43 |
| 7,015,602 | B2 * | 3/2006 | Kraus et al. | 310/36 |
| 7,180,254 | B2 * | 2/2007 | Klemm et al. | 318/135 |
| 7,288,863 | B2 * | 10/2007 | Kraus | 310/37 |
| 7,334,338 | B2 * | 2/2008 | Shiba et al. | 30/43.92 |
| 7,474,065 | B2 * | 1/2009 | Kraus | 318/119 |
| 7,504,751 | B2 * | 3/2009 | Kraus et al. | 310/13 |
| 7,707,726 | B2 * | 5/2010 | Shiba | B26B 19/046 30/43.2 |
| 8,156,652 | B2 * | 4/2012 | Takeuchi et al. | 30/43.92 |
| 8,479,397 | B2 * | 7/2013 | Sato | B26B 19/046 30/43.92 |
| 8,806,756 | B2 * | 8/2014 | Kraus et al. | 30/43.7 |
| 2004/0231160 | A1 * | 11/2004 | Shiba et al. | 30/43.92 |
| 2004/0237310 | A1 | 12/2004 | Shiba et al. | |
| 2006/0021227 | A1 * | 2/2006 | Shiba et al. | 30/43.92 |
| 2006/0085985 | A1 * | 4/2006 | Oh | B26B 19/048 30/43.92 |
| 2006/0175909 | A1 | 8/2006 | Kraus | |
| 2007/0113409 | A1 | 5/2007 | Schaaf | |
| 2007/0124937 | A1 | 6/2007 | Oh | |
| 2007/0137043 | A1 * | 6/2007 | Kraus et al. | 30/43.9 |
| 2007/0261249 | A1 * | 11/2007 | Yamasaki et al. | 30/45 |
| 2008/0034591 | A1 * | 2/2008 | Fung | 30/43.92 |
| 2008/0134514 | A1 | 6/2008 | Iwasaki et al. | |
| 2008/0209735 | A1 | 9/2008 | Haczek et al. | |
| 2008/0209736 | A1 * | 9/2008 | Shiba | 30/43.92 |
| 2009/0025229 | A1 * | 1/2009 | Kappes et al. | 30/43.92 |
| 2009/0165305 | A1 | 7/2009 | Kraus et al. | |
| 2010/0175259 | A1 | 7/2010 | Shigeta et al. | |
| 2012/0102751 | A1 | 5/2012 | Haczek et al. | |

FOREIGN PATENT DOCUMENTS

| | | | | |
|---|---|---|---|---|
| EP | 1439040 | A1 | | 7/2004 |
| EP | 2208588 | A1 | | 7/2010 |
| JP | 2004-016524 | A | | 1/2004 |
| JP | 2005-040358 | | * | 2/2005 |
| JP | 2007-506539 | A | | 3/2007 |
| JP | 2008-501451 | A | | 1/2008 |
| JP | 2008-142274 | A | | 6/2008 |
| WO | WO 2005/006538 | A1 | | 1/2005 |
| WO | WO 2005/120781 | A1 | | 12/2005 |

OTHER PUBLICATIONS

Search Report from corresponding European application 10818783.2 dated Mar. 7, 2013, pp. 1-4.

* cited by examiner

ELECTRIC SHAVER

FIELD OF THE INVENTION

RELATED APPLICATIONS

This application is a U.S. National Stage application of PCT/JP2010/066332, filed on Sep. 21, 2010, which claims priority to Japanese Patent Application No. 2009-220456, filed on Sep. 25, 2009, the entirety of which is incorporated herein.

The present invention relates to an electric shaver used to shave body hair such as facial hair.

BACKGROUND OF THE INVENTION

A conventional electric shaver is equipped with a body section incorporating a power source and a head section supported by the body section. The head section has outer blades at the upper end thereof. The outer blades are structured to draw in body hair. The outer blades are aligned in a front-back direction and are parallel with one another. Inner blades are provided on inner sides of the outer blades. The inner blades are driven by a drive source. Patent Document 1 discloses an electric shaver in which a head section swings relative to a body section in at least one of forward, backward, rightward, and leftward directions. Conventionally, a swing shaft of the head section is provided near the outer blades at the upper end of the head section. According to the structure, when a user presses the outer blades to his skin while holding the body section, the head section swings to allow the outer blades to follow the skin, improving the shaving performance.

PRIOR ART DOCUMENT

Patent Document

Patent Document 1: Japanese Laid-Open Patent Publication No. 2008-142274

SUMMARY OF THE INVENTION

The conventional electric shaver is desirably improved such that the head section has a better ability to follow the skin.

The objective of the present invention is to provide an electric shaver in which the ability of a head section to follow the skin is improved.

To achieve the foregoing objective and in accordance with a first aspect of the present invention, an electric shaver is provided that includes a body section incorporating a power source and a head section supported by the body section and configured to swing relative to the body section in at least one of forward, backward, rightward, and leftward direction. The head section has a plurality of outer blades at the upper end thereof. The outer blades are aligned in a front-back direction, parallel with each other and configured to draw in body hair, and an inner blade driven by a drive source being provided on the inner side of each outer blade. A height dimension of the head section is smaller than a front-back dimension of the head section. The drive source includes a linear actuator provided in the head section. The linear actuator has an actuator main section and a drive coupling section protruding from the actuator main section and coupled to the inner blades. A height dimension of the actuator main section is smaller than a front-back dimension of the actuator main section.

According to the present invention, the height dimension of the head section is smaller than the front-back dimension of the head section. The ratio of the height dimension to the front-back dimension of the head section is correlative to the heightwise position of the center of gravity of the head section. In other words, when the head section is formed to have a height dimension smaller than its own front-back dimension, the center of gravity of the head section can be located near the upper end of the head section. A swing shaft is located near the upper end of the head section where the outer blades are provided. Therefore, when the head section is formed to have a height dimension smaller than its own front-back dimension, the center of gravity of the head section can be located near the swing shaft of the head section. This improves the ability of the head section to follow the skin. In the actuator main section of the linear actuator configured to drive the inner blades, the height dimension is similarly smaller than the front-back dimension. This facilitates reduction in the height dimension of the head section incorporating the linear actuator to values smaller than the front-back dimension of the head section. This further improves the ability of the head section to follow the skin.

The actuator main section preferably includes a movable element and a stator that includes a plurality of coils, and the coils are preferably aligned in a direction orthogonal to the height direction of the actuator main section and are parallel with each other.

The present invention thus can reduce the height dimension of the actuator main section without undermining the driving force of the linear actuator.

The coils are preferably aligned in a front-back direction of the actuator main section and are parallel with each other.

The present invention facilitates reduction in the height dimension of the actuator main section to values smaller than the front-back dimension of the actuator main section.

Each coil is preferably situated with the axis thereof extending in the direction orthogonal to the height direction of the actuator main section, and the movable element preferably faces the coils along a direction orthogonal to the height direction of the actuator main section.

The present invention is structurally characterized in that the movable element of the actuator main section is facing the coils in a direction orthogonal to the height direction. This leads to further downsizing of the actuator main section in the height direction.

DETAILED DESCRIPTION OF THE PREFERRED EMBODIMENT (First Embodiment)

Hereinafter, a three-blade electric shaver according to a first embodiment of the present invention will be is described referring to FIGS. 1 to 4.

Figure 1:
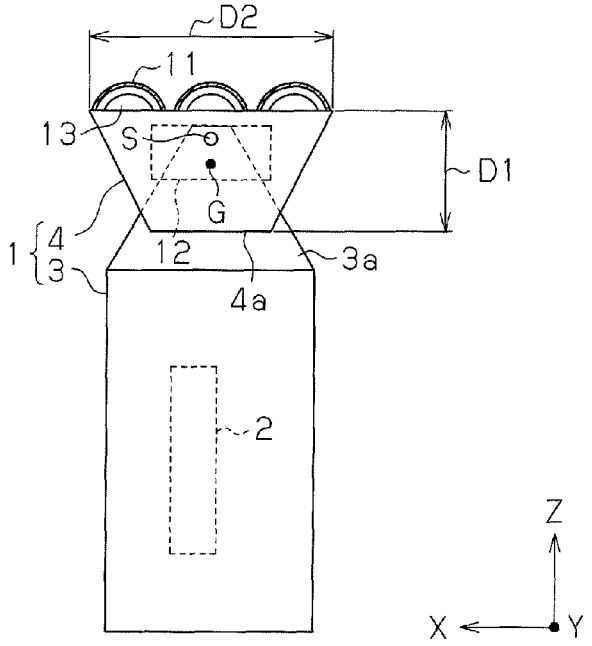
FIG. 1 is a side view schematically illustrating an electric shaver according to a first embodiment of the present invention.

As illustrated in FIG. 1, an electric shaver 1 is equipped with a body section 3 incorporating a power source 2, and a head section 4 provided at the upper end of the body section 3. The body section 3 has a supporting portion 3*a* provided in the upper end thereof to support the head section 4. The head section 4 swings in the supporting portion 3*a* in a front-back direction X with a support shaft S as a swing axis. The head section 4 has three outer blades 11 formed from thin metal plates at the upper end thereof. The outer blades 11 are aligned in the front-back direction X and are parallel with one another. The outer blades 11 respectively have a plurality of holes formed to draw in body hair. The outer blades 11 are secured to a resin support frame not illustrated in the drawings. The blades 11 and the resin support frame constitute an outer blade block. A swing shaft (support shaft S) of the head section 4 is located near the outer blades 11. More specifically, the swing shaft of the head section 4 is located near the upper end of a housing member in which the head section 4 is housed. An inner blade 13 is provided on the inner side of each outer blade 11. The inner blades 13 are configured to reciprocate in a right-left direction Y which is a direction orthogonal to the drawing plane in FIG. 1. The head section 4 incorporates a linear actuator 12. The inner blades 13 are reciprocated by the linear actuator 12. The front-back direction X, a right-left direction Y, and a height direction Z are orthogonal to one another.

The linear actuator 12 is electrically connected to the power source 2. The linear actuator 12 is driven when an operation switch provided in the body section 3 (not illustrated in the drawings) is operated. When body hair such as facial hair is drawn in through the holes formed in the outer blades 11, the body hair is nipped by the outer blades 11 and the reciprocating inner blades 13 to be cut. When a user presses the outer blades 11 of the head section 4 to his skin while holding the body section 3, the head section 4 swings in the front-back direction X to let the outer blades 11 follow the skin.

[Structure of Linear Actuator]

Figure 2:
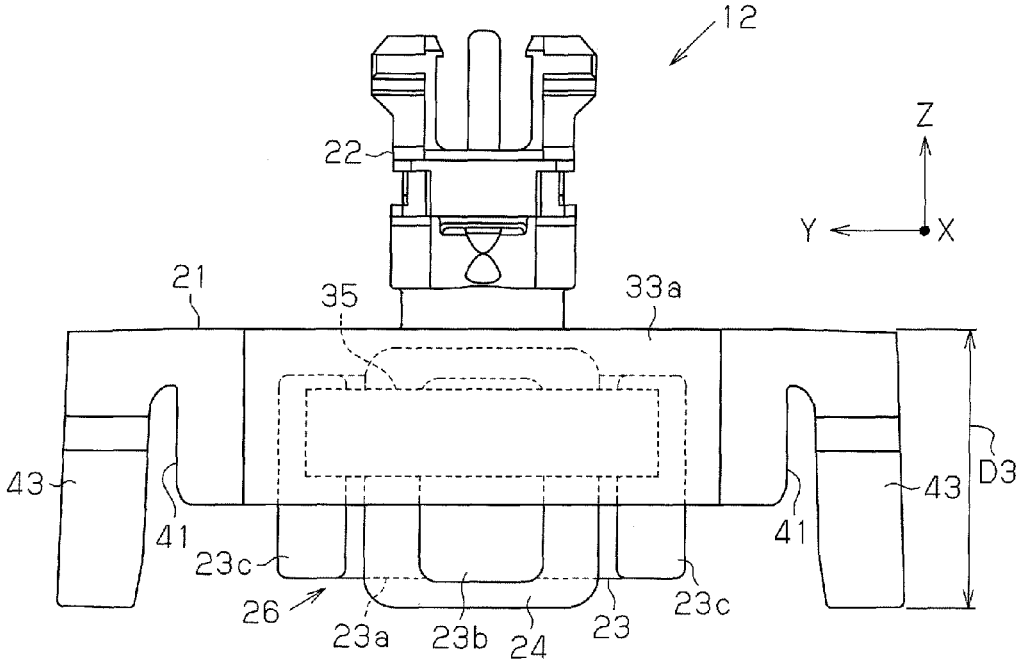
FIG. 2 is a front view of a linear actuator.
Figure 3:
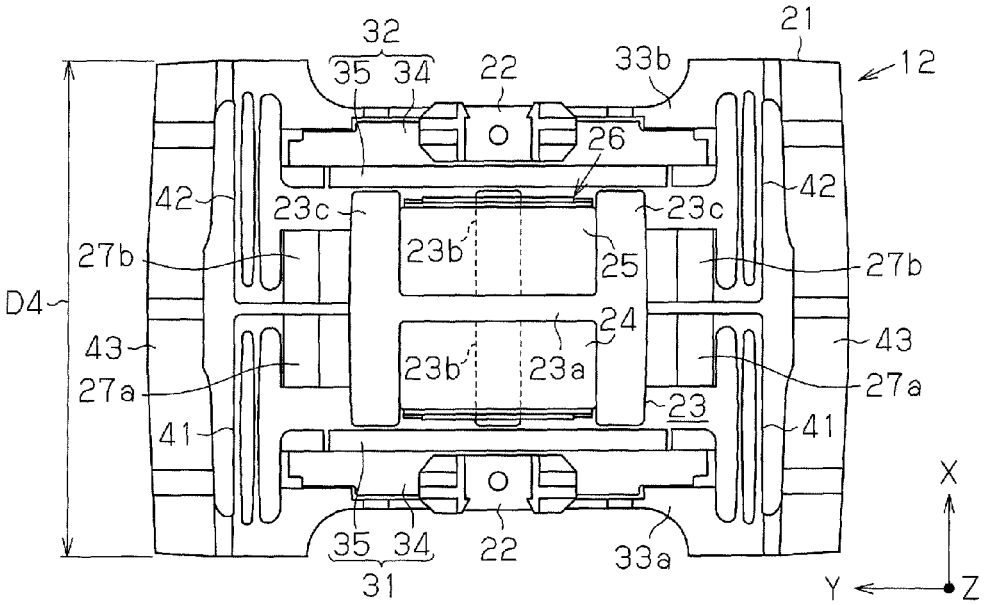
FIG. 3 is a plan view of the linear actuator.
Figure 4:
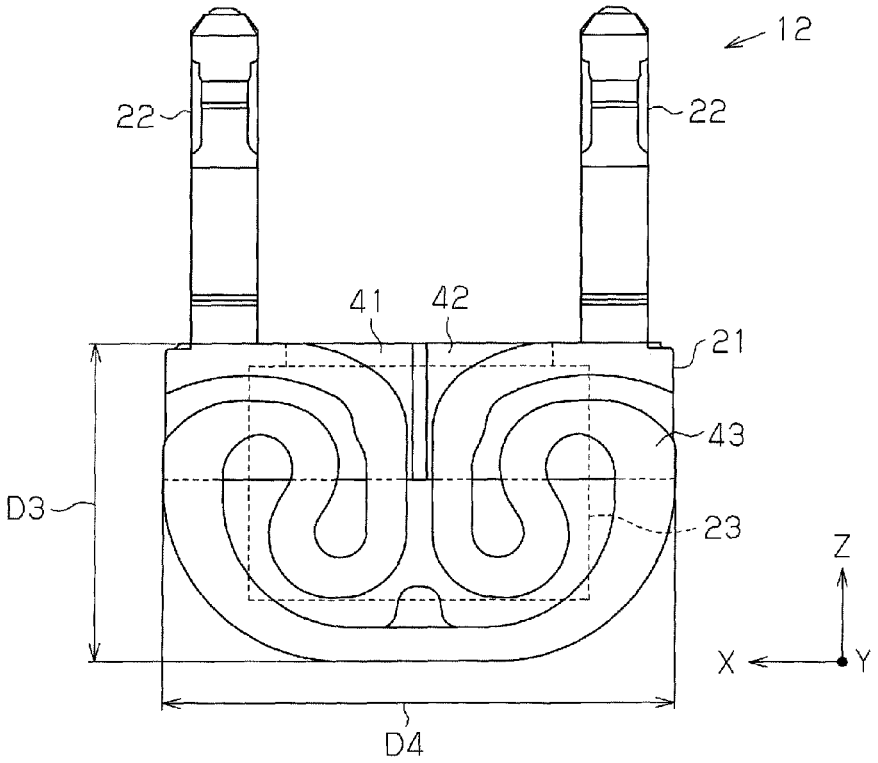
FIG. 4 is a side view of the linear actuator.

As illustrated in FIGS. 2 to 4, the linear actuator 12 is equipped with an actuator main section 21 and two drive coupling sections 22. The two drive coupling sections 22 both protrude upward from the actuator main section 21.

As illustrated in FIG. 3, a stator 26 including an iron core 23 and a pair of coils 24 and 25 is provided in a center part of the actuator main section 21 as viewed in the height direction Z. The iron core 23 is securely pinched in the right-left direction Y by a first pair of stator-side support portions 27*a* and a second pair of stator-side support portions 27*b*. The first stator-side support portions 27*a* and the second stator-side support portions 27*b* are aligned in the front-back direction X and are parallel with each other. The iron core 23 has a base section 23*a* extending in the right-left direction Y, tooth sections 23*b* respectively extending forward and backward from the center of the base section 23*a*, and extending sections 23*c* extending forward and backward respectively from both ends of the base section 23*a*. The coils 24 and 25 are wound about the tooth sections 23*b*, respectively. The coils 24 and 25 are situated with axes thereof extending in the front-back direction X. The coils 24 and 25 are located between the extending sections 23*c* provided in a pair. The coils 24 and 25 are electrically connected to the power source 2 via connection terminals (not shown) provided in coils 24 and 25 so that the coils 24 and 25 are fed with power from the power source 2.

A movable element 31 is provided near one of the front end and the rear end of the stator 26, and a movable element 32 is provided near the other one of the front and rear ends. The movable element 31 has a yoke 34 supported by a first movable element-side support portion 33*a* and a magnet 35 secured to the yoke 34. The magnet 35 of the movable element 31 is facing the coil 24. The movable element 32 has a yoke 34 supported by a second movable element-side support portion 33*b* and a magnet 35 secured to the yoke 34. The magnet 35 of the movable element 32 and the coil 25 are facing each other. The magnet 35 of the movable element 32 is facing the coil 25. A magnetic field action generated by the power fed to the coil 24 makes the movable element 31 reciprocate with the first movable element-side support portion 33*a* in the right-left direction Y. A magnetic field action generated by the power fed to the coil 25 causes the movable element 32 to reciprocate with the second movable element-side support portion 33*b* in the right-left direction Y.

The respective first stator-side support portions 27*a* and the first movable element-side support portion 33*a* are coupled to each other by suspension springs 41 at both ends thereof in the right-left direction Y. The respective second stator-side support portions 27*b* and the second movable element-side support portion 33*b* are similarly coupled to each other by suspension springs 42 at both ends thereof in the right-left direction Y. The actuator main section 21 has linear coupling springs 43 provided at both ends thereof in the right-left direction Y. The first and second movable element-side support portions 33*a* and 33*b* are coupled to each other by linear coupling springs 43. The linear coupling springs 43 allow reciprocating vibration of the first and second movable element-side support portions 33*a* and 33*b* in the right-left direction Y.

The movable elements 31 and 32 provided in a pair are respectively coupled to the drive coupling sections 22 to move integrally with the drive coupling sections 22. The drive coupling sections 22 are coupled to the inner blades 13. Therefore, driving of the movable elements 31 and 32 is started when the coils 24 and 25 are fed with power. When driving forces of the movable elements 31 and 32 are transmitted to the inner blades 13 by way of the drive coupling sections 22, the inner blades 13 start to vibrate in a reciprocating manner.

As illustrated in FIG. 1, the head section 4 of the electric shaver 1 has a height dimension D1 and a front-back dimension D2. The height dimension D1 is smaller than the front-back dimension D2. The ratio of the height dimension D1 to the front-back dimension D2 is correlative to the heightwise position of the center of gravity G of the head section 4. Specifically, the position of the center of gravity G of the head section 4 is elevated as the height dimension D1 of the head section 4 is made smaller than the front-back dimension D2. In other words, in the electric shaver 1, in which the height dimension D1 of the head section 4 is smaller than the front-back dimension D2, the center of gravity G of the head section 4 can be set near the upper end of the head section 4, which is near the swing shaft (support shaft S). This improves the ability of the head section 4 to follow the skin. The height dimension D1 of the head section 4 is more specifically the height dimension of the head section 4 from a lower end 4*a* of the head section 4 to the upper end of the outer blades 11.

As illustrated in FIG. 4, a height dimension D3 of the actuator main section 21 is smaller than a width dimension D4 of the actuator main section 21. This facilitates reduction in the height dimension D1 of the head section 4 to values smaller than the front-back dimension D2, thereby further improving the ability of the head section 4 to follow the skin. The actuator main section 21 does not include the connection terminals of the coils 24 and 25.

The first embodiment has the following advantages.

(1) In the head section 4, the height dimension D1 is smaller than the front-back dimension D2. Therefore, the center of gravity G of the head section 4 can be located near the upper end of the head section 4. In the head section 4, the swing shaft (support shaft S) is located near the upper end of the head section 4 where the outer blades 11 are provided. Therefore, the center of gravity G of the head section 4 can be located near the swing shaft of the head section 4 as far as the height dimension D1 of the head section 4 is smaller than the front-back dimension D2. This improves the ability of the head section 4 to follow the skin. The actuator main section 21 of the linear actuator 12, which is configured to drive the inner blades 13, similarly has the height dimension D3 smaller than the front-back dimension D4. Accordingly, the height dimension D1 of the head section 4 incorporating the linear actuator 12 can easily be reduced to values smaller than the front-back dimension D2. This further improves the ability of the head section 4 to follow the skin.

(2) In the stator 26 of the actuator main section 21, the coils 24 and 25 are aligned in the direction orthogonal to the height direction Z and are parallel with each other. This succeeds in reducing the size of the actuator main section 21 in the height direction Z without undermining the driving force of the linear actuator 12.

(3) The coils 24 and 25 are aligned in the front-back direction X and are parallel with each other. This facilitates to reduce the height dimension D3 of the actuator main section 21 to values smaller than the front-back dimension D4.

(4) The coils 24 and 25 are situated with the axes thereof extending in the front-back direction X. The movable elements 31 and 32 of the actuator main section 21 are respectively facing the coils 24 and 25 in the front-back direction X. This leads to a further reduction in the size of the actuator main section 21 in the height direction Z.

(Second Embodiment)

Hereinafter, a second embodiment of the present invention, in which the electric shaver according to the present invention is applied to a five-blade electric shaver, is described with reference to FIGS. 5 to 7. Any structural elements according to the second embodiment configured similarly to those of the first embodiment will not be described in detail.

Figure 5:
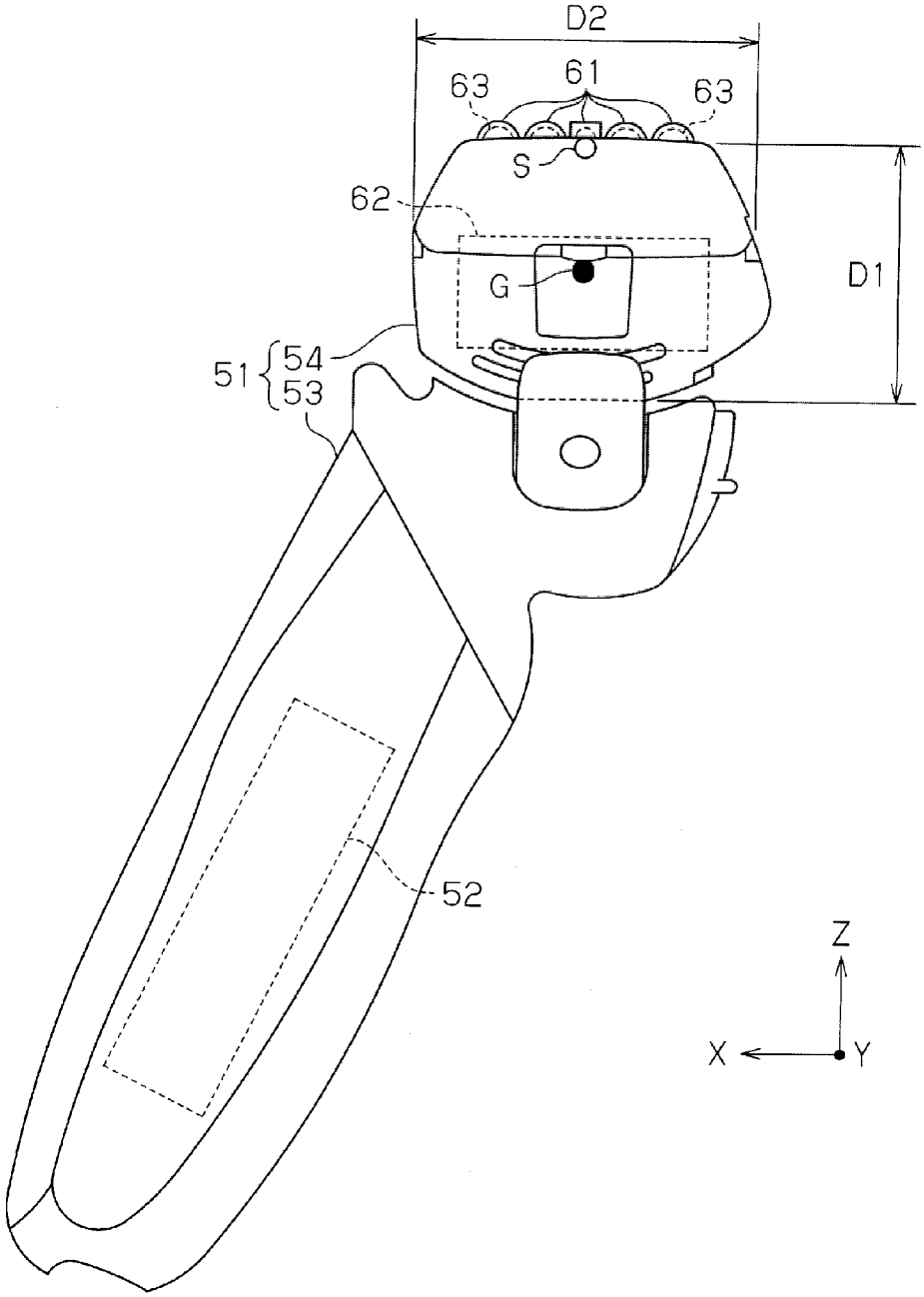
FIG. 5 is a side view schematically illustrating an electric shaver according to a second embodiment of the present invention.

As illustrated in FIG. 5, an electric shaver 51 is equipped with a body section 53 incorporating a power source 52, and a head section 54 provided at the upper end of the body section 53. The head section 54 swings in a front-back direction X with a support shaft S as a swing axis. The head section 54 has five outer blades 61 at the upper end thereof. The outer blades 61 are aligned in the front-back direction X and are parallel with one another. An Inner blade 63 is provided on the inner side of each outer blade 61. The inner blades 63 are configured to be reciprocated by a linear actuator 62 provided in the head section 54.

Figure 6:
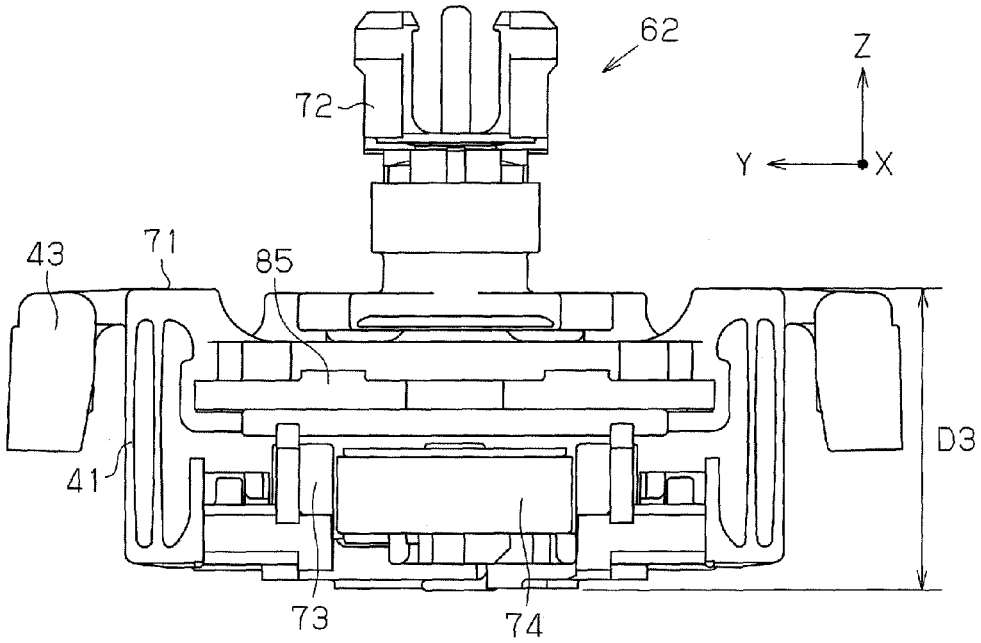
FIG. 6 is a front view of a linear actuator.
Figure 7:
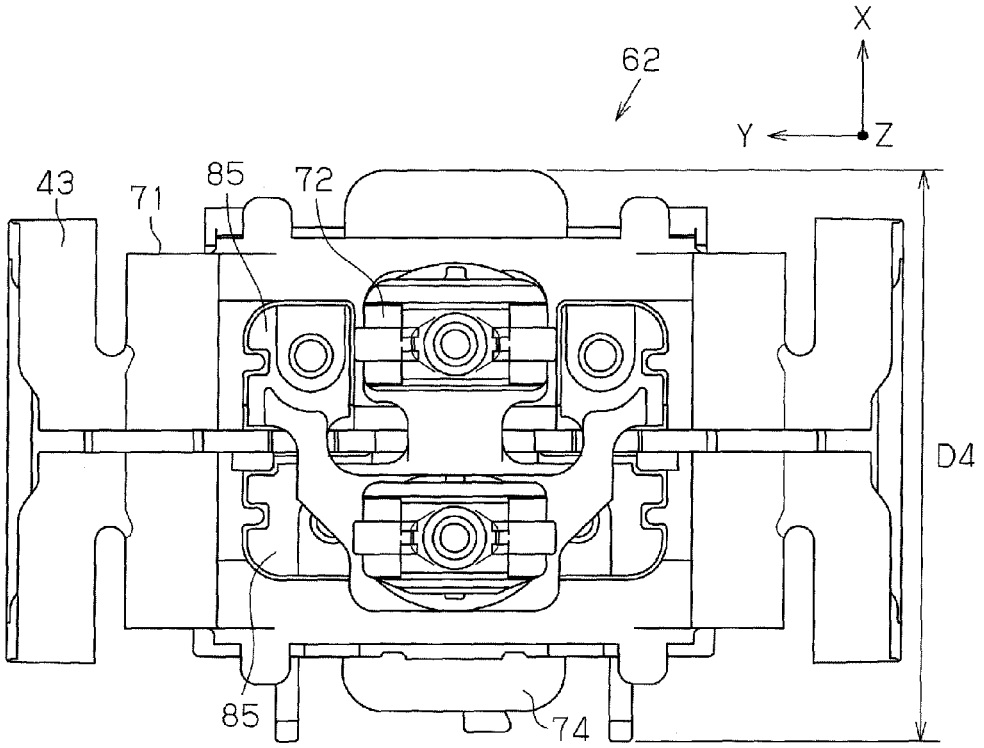
FIG. 7 is a plan view of the linear actuator.

As illustrated in FIGS. 6 and 7, an iron core 73 and a coil 74 wound around tooth sections of the iron core 73 in a center part of an actuator main section 71. The coil 74 is situated with an axis thereof extending in a height direction Z. In the center part of the actuator main section 71, a pair of magnets 85 having a flat-plate shape constituting a movable element is provided at a position facing the upper end surface of the coil 74. The magnets 85 are situated with the thickness direction thereof directed toward the axis of the coil 74. More specifically, the magnets 85 are situated such that the surfaces thereof are orthogonal to the axis of the coil 74. When the coil 74 is fed with power, the movable element starts to be driven, and the inner blades 63 vibrate in a reciprocating manner with a drive coupling section 72.

As illustrated in FIG. 5, the head section 54 of the electric shaver 51 has a height dimension D1 smaller than a front-back dimension D2 thereof. The ratio of the height dimension D1 to the front-back dimension D2 is correlative to a heightwise position of the center of gravity G of the head section 54. Specifically, the position of the center of gravity G of the head section 54 can also be located near the upper end of the head section 54, that is, the center of gravity G can be located near the swing shaft (support shaft S). As illustrated in FIGS. 6 and 7, the actuator main section 71 has a height dimension D3 smaller than a front-back dimension D4 thereof. This facilitates to reduce the height dimension D1 of the head section 54 to values smaller than the front-back dimension D2.

The second embodiment has the following advantages.

(5) In the head section 54, the height dimension D1 is smaller than the front-back dimension D2. Therefore, the center of gravity G of the head section 54 can be located near the upper end of the head section 4. In the actuator main section 71, the height dimension D3 is smaller than the front-back dimension D4, facilitating to reduce the height dimension D1 of the head section 54 to be smaller than the front-back dimension D2. This further improves the ability of the head section 54 to follow the skin. Thus, according to the present invention, the five-blade electric shaver 51 achieves advantages similar to those of the three-blade electric shaver 1.

(6) According to the second embodiment, the coil 74 is situated with the axis thereof extending in the height direction Z, and the flat magnets 85 are situated so that their surfaces are orthogonal to the axis of the coil 74. According to such a structure, when the dimensions of the magnets 85 in the front-back direction X are set to large values, the size of the actuator main section 71 can be reduced in the height direction Z, and the linear actuator 62 can still maintain an expected driving force. The movable element including the magnets 85 achieves a better weight balance and driving balance as compared to a movable element with one magnet.

According to the first embodiment, the coils 24 and 25 are aligned in the front-back direction X and are parallel with each other. However, the coils 24 and 25 may be aligned in the right-left direction Y and parallel with each other.

According to the first embodiment, the movable elements 31 and 32 of the actuator main section 21 are respectively facing the coils 24 and 25 in the front-back direction X. However, the movable elements 31 and 32 may be provided to face the coils 24 and 25 in the right-left direction Y.

The head sections 4 and 54 according to the exemplary embodiments described so far are configured to swing in the front-back direction X. However, the head sections 4 and 54 may be configured to swing in the right-left direction Y or swing in the front-back direction X and the right-left direction Y both.

The present invention is not limitedly applicable to the three- and five-blade electric shavers but is also applicable to other electric shavers.

The inner blades 13 and 63 according to the exemplary embodiments described so far may be a screw blade or a rotary blade.

The movable element having the magnets 85 according to the second embodiment may be replaced with a movable element having only one magnet.

The invention claimed is:

1. An electric shaver, comprising:

a body section incorporating a power source, wherein the body section includes a support portion arranged at an upper end of the body section;

a head section pivotally supported by the support portion of the body section such that the head section is configured to pivot about a first axis, wherein the head section includes an upper end and a lower end;

a plurality of outer blades arranged in parallel with each other at the upper end of the head section in a first plane that is orthogonal to the first axis, wherein the plurality of outer blades protrude in a first direction from the upper end of the head section;

an actuator incorporated in the head section, wherein the actuator is electrically connected to the power source incorporated in the body section and includes an actuator main section, which includes an upper end and a lower end, and a drive coupling section, which protrudes in the first direction from the upper end of the actuator main section, wherein the actuator main section includes a stator and a movable element configured to reciprocate along a second direction relative to the stator, and the drive coupling section is coupled to and configured to be reciprocated by the movable element, wherein the second direction is orthogonal to the first plane; and a plurality of inner blades supported by the drive coupling section of the actuator, the plurality of inner blades being coupled to the drive coupling section and configured to reciprocate along the second direction;

wherein a first maximum height from the upper end to the lower end of the head section is smaller than a first maximum width of the head section along a third direction that is orthogonal to both the first direction and the second direction, wherein a second maximum height from the upper end to the lower end of the actuator main section is smaller than a second maximum width of the actuator main section along the third direction, wherein the stator includes a plurality of tooth sections and a plurality of coils respectively wound about the plurality of tooth sections, wherein the plurality of tooth sections have a common axis orthogonal to the longitudinal axis of the body section, wherein the common axis is orthogonal to a longitudinal axis of the outer blades, and wherein the movable element has a surface that faces an end face of each of the plurality of coils.

* * * * *